US012742307B2

(12) United States Patent
Nishikawa et al.

(10) Patent No.: US 12,742,307 B2
(45) Date of Patent: Sep. 22, 2026

(54) CONSTRUCTION MACHINE

(71) Applicant: Hitachi Construction Machinery Co., Ltd., Tokyo (JP)

(72) Inventors: Shinji Nishikawa, Kasumigaura (JP); Ryohei Yamashita, Sumida-ku (JP); Akihiro Narazaki, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 148 days.

(21) Appl. No.: 18/277,842

(22) PCT Filed: Dec. 16, 2021

(86) PCT No.: PCT/JP2021/046636
§ 371 (c)(1),
(2) Date: Aug. 18, 2023

(87) PCT Pub. No.: WO2022/209045
PCT Pub. Date: Oct. 6, 2022

(65) Prior Publication Data

US 2024/0125091 A1 Apr. 18, 2024

(30) Foreign Application Priority Data

Mar. 31, 2021 (JP) ..... 2021-061183

(51) Int. Cl.
*E02F 9/20* (2006.01)
*E02F 9/24* (2006.01)
(Continued)

(52) U.S. Cl.
CPC ..... *E02F 9/205* (2013.01); *E02F 9/24* (2013.01); *E02F 9/26* (2013.01); *E02F 9/2228* (2013.01);
(Continued)

(58) Field of Classification Search
CPC ..... E02F 9/205; E02F 9/24; E02F 9/26; E02F 9/2228; E02F 9/2285; E02F 9/2292;
(Continued)

(56) References Cited

U.S. PATENT DOCUMENTS

2021/0034058 A1* 2/2021 Subramanian ..... G06T 17/05
2022/0412047 A1* 12/2022 Hama ..... G05D 1/2247
2023/0227054 A1* 7/2023 Hagerskans ..... B60T 13/745 701/23

FOREIGN PATENT DOCUMENTS

EP 2843140 A1 * 3/2015 ..... E02F 9/268
JP 58-26130 A 2/1983
(Continued)

OTHER PUBLICATIONS

International Search Report (PCT/ISA/210) issued in PCT Application No. PCT/JP2021/046636 dated Mar. 8, 2022 with English translation (6 pages).
(Continued)

*Primary Examiner* — Rachid Bendidi
*Assistant Examiner* — Joseph Anderson Yanoska
(74) *Attorney, Agent, or Firm* — Crowell & Moring LLP

(57) ABSTRACT

A machine controller that controls an action of the construction machine; an external operation controller that controls unmanned operation that does not require operation by an operator riding in an operation room, by generating a control signal according to an operation signal received from an outside via a communication terminal, and sending the control signal to the machine controller; an approach permission signaling light that signals permission for a worker to approach the construction machine; and an action request signaling light that signals a request for riding in the operation room and performing a particular action to a nearby worker are provided, and the external operation controller is configured to control the approach permission
(Continued)

signaling light to be turned on when it is decided that approach of the worker to the construction machine can be tolerated according to information collected by the machine controller, and also control the action request signaling light to be turned on when it is decided that it is necessary to request a nearby worker to take a particular action. Thereby, it is possible to succinctly notify nearby workers and a manager of a machine-body action state, and to realize both the safety and work efficiency of the workers near the machine body and the manager.

1 Claim, 10 Drawing Sheets

(51) Int. Cl.
*E02F 9/26* (2006.01)
*E02F 9/22* (2006.01)

(52) U.S. Cl.
CPC ..... *E02F 9/2285* (2013.01); *E02F 9/2292* (2013.01); *E02F 9/2296* (2013.01)

(58) Field of Classification Search
CPC ..... E02F 9/2296; E02F 9/265; E02F 9/267; G08B 5/36; G08B 5/22; H04Q 9/02; H04Q 2209/40; B60Y 2200/412
See application file for complete search history.

(56) References Cited

FOREIGN PATENT DOCUMENTS

| | | | |
|---|---|---|---|
| JP | 6-311570 | A | 11/1994 |
| JP | 8-255019 | A | 10/1996 |
| JP | 2002-180503 | A | 6/2002 |
| JP | 2013-243952 | A | 12/2013 |
| JP | 2015-192163 | A | 11/2015 |
| JP | 6212197 | B1 | 10/2017 |
| JP | 2020-197123 | A | 12/2020 |
| KR | 10-2015-0066723 | A | 6/2015 |

OTHER PUBLICATIONS

Japanese-language Written Opinion (PCT/ISA/237) issued in PCT Application No. PCT/JP2021/046636 dated Mar. 8, 2022 with English translation (7 pages).
Japanese-language International Preliminary Report on Patentability (PCT/IPEA/409) issued in PCT Application No. PCT/JP2021/046636 dated Apr. 6, 2023, including Annexes with English translation (14 pages).
International Preliminary Report on Patentability (PCT/IB/338) issued in PCT Application No. PCT/JP2021/046636 dated Oct. 5, 2023, including English translation (Japanese-language International Preliminary Report on Patentability (PCT/IPEA/409), filed on Aug. 18, 2023) (4 pages).

* cited by examiner

FIG. 3

RELATION BETWEEN DISPLAY COLOR AND USE (LIGHTING CONDITION) OF EACH STATE SIGNALING LIGHT

| | 201 NAME | 202 DISPLAY COLOR | 203 USE (LIGHTING CONDITION) |
|---|---|---|---|
| 201a | WORK SIGNALING LIGHT | YELLOW | TURNED ON WHEN ENGINE IS IN OPERATION |
| 201b | WARNING SIGNALING LIGHT | RED | TURNED ON WHEN ANOMALY THAT CAN DISRUPT UNMANNED OPERATION (REMOTE OPERATION, AUTOMATED OPERATION) HAS OCCURRED |
| 201c | COMMUNICATION SIGNALING LIGHT | BLUE | TURNED ON WHEN COMMUNICATION BETWEEN MACHINE BODY AND REMOTE OPERATION APPARATUS OR CONTROL ROOM IS BEING PERFORMED NORMALLY |
| 201d | OPERATION SIGNALING LIGHT | GREEN | TURNED ON WHEN UNMANNED OPERATION (REMOTE OPERATION, AUTOMATED OPERATION) IS FUNCTIONING NORMALLY |
| 201e | APPROACH PERMISSION SIGNALING LIGHT | GREEN | TURNED ON WHEN APPROACH OF WORKER TO CONSTRUCTION MACHINE IS PERMITTED |
| 201f | ACTION REQUEST SIGNALING LIGHT | BLUE | TURNED ON WHEN RIDING BY WORKER (OPERATOR, NEARBY WORKER) IN OPERATION ROOM AND PARTICULAR ACTION BY RIDING WORKER ARE SUPPLIED |

FIG. 5

RELATION BETWEEN CONTROL STATE AND PERMISSION/PROHIBITION OF MACHINE-BODY OPERATION

| | 211 CONTROL STATE | 212 PERMISSION/PROHIBITION OF MACHINE-BODY OPERATION BY RIDING OPERATOR | 213 PERMISSION/PROHIBITION OF MACHINE-BODY OPERATION BY REMOTE (OUTSIDE) COMMAND |
|---|---|---|---|
| 310 | MANNED OPERATION STATE | ENABLED | PROHIBITED (DISABLED) |
| 321 | UNMANNED-OPERATION TEMPORARILY CANCELLED STATE | ENABLED | PROHIBITED (DISABLED) |
| 322 | UNMANNED OPERATION WAITING STATE | PROHIBITED (DISABLED) | PROHIBITED (DISABLED) |
| 323 | UNMANNED OPERATION WORK STATE | PROHIBITED (DISABLED) | ENABLED |
| 324 | UNMANNED OPERATION FORCED STOP STATE | ENABLED | PROHIBITED (DISABLED) |

FIG. 7

RELATION BETWEEN DISPLAY COLOR AND LIGHTING CONDITION OF EACH STATE SIGNALING LIGHT (MANNED OPERATION STATE: LIGHTING CONTROL PATTERN 1)

230

| | 221 NAME | 222 DISPLAY COLOR | 223 LIGHTING CONDITION (MACHINE-BODY STATE WHEN LIGHT IS TURNED ON) |
|---|---|---|---|
| 221a | WORK SIGNALING LIGHT | YELLOW | ENGINE STATE: IN OPERATION |
| 221b | WARNING SIGNALING LIGHT | RED | NO (ALWAYS TURNED OFF) |
| 221c | COMMUNICATION SIGNALING LIGHT | BLUE | NO (ALWAYS TURNED OFF) |
| 221d | OPERATION SIGNALING LIGHT | GREEN | NO (ALWAYS TURNED OFF) |
| 221e | APPROACH PERMISSION SIGNALING LIGHT | GREEN | "ENGINE STATE: STOPPED" OR"LOCK VALVE: INTERRUPTING" |
| 221f | ACTION REQUEST SIGNALING LIGHT | BLUE | NO (ALWAYS TURNED OFF) |

FIG. 8

RELATION BETWEEN DISPLAY COLOR AND LIGHTING CONDITION OF EACH STATE SIGNALING LIGHT (MANNED OPERATION STATE: LIGHTING CONTROL PATTERN 2)

231

| | 221 NAME | 222 DISPLAY COLOR | 223 LIGHTING CONDITION (MACHINE-BODY STATE WHEN LIGHT IS TURNED ON) |
|---|---|---|---|
| 221a | WORK SIGNALING LIGHT | YELLOW | ENGINE STATE: IN OPERATION |
| 221b | WARNING SIGNALING LIGHT | RED | NO (ALWAYS TURNED OFF) |
| 221c | COMMUNICATION SIGNALING LIGHT | BLUE | NO (ALWAYS TURNED OFF) |
| 221d | OPERATION SIGNALING LIGHT | GREEN | NO (ALWAYS TURNED OFF) |
| 221e | APPROACH PERMISSION SIGNALING LIGHT | GREEN | NO (ALWAYS TURNED OFF) |
| 221f | ACTION REQUEST SIGNALING LIGHT | BLUE | NO (ALWAYS TURNED OFF) |

FIG. 9

RELATION BETWEEN DISPLAY COLOR AND LIGHTING CONDITION OF EACH STATE SIGNALING LIGHT
(MANNED OPERATION STATE: LIGHTING CONTROL PATTERN 3)

| | 221 NAME | 222 DISPLAY COLOR | 223 LIGHTING CONDITION (MACHINE-BODY STATE WHEN LIGHT IS TURNED ON) |
|---|---|---|---|
| 221a | WORK SIGNALING LIGHT | YELLOW | ENGINE STATE: IN OPERATION |
| 221b | WARNING SIGNALING LIGHT | RED | NO (ALWAYS TURNED OFF) |
| 221c | COMMUNICATION SIGNALING LIGHT | BLUE | NO (ALWAYS TURNED OFF) |
| 221d | OPERATION SIGNALING LIGHT | GREEN | "ENGINE STATE: STOPPED" OR"LOCK VALVE: INTERRUPTING" |
| 221e | APPROACH PERMISSION SIGNALING LIGHT | GREEN | NO (ALWAYS TURNED OFF) |
| 221f | ACTION REQUEST SIGNALING LIGHT | BLUE | NO (ALWAYS TURNED OFF) |

232

FIG. 10

RELATION BETWEEN DISPLAY COLOR AND LIGHTING CONDITION OF EACH STATE SIGNALING LIGHT (UNMANNED OPERATION STATE)

| | 221 NAME | 222 DISPLAY COLOR | 223 LIGHTING CONDITION (MACHINE-BODY STATE WHEN LIGHT IS TURNED ON) |
|---|---|---|---|
| 221a | WORK SIGNALING LIGHT | YELLOW | ENGINE STATE: IN OPERATION |
| 221b | WARNING SIGNALING LIGHT | RED | CONTROL STATE: UNMANNED OPERATION FORCED STOP STATE |
| 221c | COMMUNICATION SIGNALING LIGHT | BLUE | "CONTROL STATE: UNMANNED-OPERATION TEMPORARILY CANCELLED STATE, UNMANNED OPERATION WAITING STATE, UNMANNED OPERATION WORK STATE, OR UNMANNED OPERATION FORCED STOP STATE" AND "NETWORK CONNECTION BETWEEN MACHINE BODY AND CONTROL ROOM: NORMAL" |
| 221d | OPERATION SIGNALING LIGHT | GREEN | CONTROL STATE: UNMANNED OPERATION WORK STATE |
| 221e | APPROACH PERMISSION SIGNALING LIGHT | GREEN | "CONTROL STATE: UNMANNED-OPERATION TEMPORARILY CANCELLED STATE, UNMANNED OPERATION WAITING STATE, OR UNMANNED OPERATION FORCED STOP STATE" AND "'ENGINE STATE: STOPPED' OR 'LOCK VALVE: INTERRUPTING'" |
| 221f | ACTION REQUEST SIGNALING LIGHT | BLUE | "ANOMALOUS STATE THAT REQUESTS PARTICULAR ACTION TO BE PERFORMED BY WORKER BY RIDING IN OPERATION ROOM HAS OCCURRED (ONE CONDITION OF UNMANNED OPERATION FORCED STOP STATE)" OR "ACTION REQUEST SIGNALING LIGHT TURN-ON SIGNAL: RECEIVED" |

CONSTRUCTION MACHINE

TECHNICAL FIELD

The present invention relates to a construction machine.

BACKGROUND ART

In operational use of construction machines represented by hydraulic excavators, notifications that the construction machines are in operation are given to nearby workers by using rotating lights or the like to prompt the nearby workers to pay attention, in order to suppress careless approach of the nearby workers to the construction machines operating at a work site.

As a technology to actively notify nearby workers of a machine-body state to call their attention by using light-emitting bodies installed along the shape of a construction machine such that the construction machine can be recognized even at night, for example, a technology described in Patent Document 1 is known. Patent Document 1 discloses a work vehicle including: a lower travel structure; an upper swing structure that is freely swingably attached to the upper portion of the lower travel structure, and has an operation room mounted thereon; and a work implement that is attached to the upper swing structure such that it can freely face the upward direction and the downward direction, and in the work vehicle, linear light-emitting bodies are attached to the outer surface of the upper swing structure.

In addition, as a technology that uses signaling lights provided to a machine body to make it possible to check an anomaly during automated operation of the machine body from a remote location at a time when a worker is not riding in the machine body such as a time of remote operation or automated operation, for example, a technology described in Patent Document 2 is known. Patent Document 2 discloses an automated travel vehicle including: a frame of the vehicle; an engine placed on the frame; wheels driven by motive power of the engine; a travel operation device; a controller that controls the travel operation device; a body mounted on the vehicle; a signaling lamp installed on the upper portion of the body; an operation panel having a switch for switching between a manual mode in which manned operation is performed and an automatic mode in which unmanned operation is performed; and a remote controller that gives commands for operation-mode switching, activation, and stop by remote operation.

PRIOR ART DOCUMENT

Patent Documents

Patent Document 1: JP-2002-180503-A
Patent Document 2: JP-1996-255019-A

SUMMARY OF THE INVENTION

Problems to be Solved by the Invention

Meanwhile, where a work machine performs unmanned operation (remote operation, automated operation), it is conceivable that a situation occurs where it becomes inevitably necessary for a worker near the construction machine to approach the machine body performing the unmanned operation or it becomes necessary to ask to suspend the work performed by the construction machine.

At this time, for example, even where the nearby worker can forcibly stop the construction machine performing the unmanned operation (remote operation, automated operation), if the unmanned operation is actually stopped, the work by the unmanned operation is unintendedly suspended or stopped undesirably, and this cause unnecessary deterioration of the work efficiency undesirably.

Even where a manager who is remotely managing the unmanned operation (remote operation, automated operation) of the construction machine is asked to temporarily suspend the unmanned operation by some notification means, a nearby worker cannot approach the work machine since she/he cannot check the safety unless the nearby worker is informed that the machine body is in a state where it does not start moving, and this causes deterioration of the work efficiency undesirably. In addition, it is also conceivable that even where the unmanned operation is not suspended, a nearby worker misinterprets the motionless appearance of the work machine as indicative of suspension of the unmanned operation, and carelessly approaches the construction machine undesirably.

In addition, when unmanned operation (remote operation/automated operation) of the work machine is stopped undesirably due to some malfunction such as interruption of network communication, it is necessary for someone in workers including a manager to ride in the operation room to operate the machine body in order to stop the engine of the construction machine that is in operation, in order to cause the construction machine to withdraw temporarily, and so on. However, when the construction machine and the control room (i.e. the manager) are far away from each other, it undesirably takes an enormous amount of time for the manager to move to the construction machine, and the work takes an enormous amount of time undesirably.

The present invention has been made in view of matters described above, and an object of the present invention is to provide a construction machine that can succinctly notify nearby workers and a manager of a machine-body action state, and can realize both the safety and work efficiency of the workers and the manager near the machine body.

Means for Solving the Problems

The present application includes a plurality of means for solving the problems described above, and an example thereof is a construction machine whose operation can be switched between manned operation and unmanned operation, the construction machine including: a machine controller that controls an action of the construction machine; an external operation controller that controls unmanned operation that does not require operation by an operator riding in an operation room, by generating a control signal according to an operation signal received from an outside via a communication terminal, and sending the control signal to the machine controller; an approach permission signaling light that signals permission for a worker to approach the construction machine; and an action request signaling light that signals a request for riding in the operation room and performing a particular action to a nearby worker, in which the approach permission signaling light is arranged on a front left side of the operation room such that the approach permission signaling light can be easily recognized by a riding operator in the operation room, and the external operation controller is configured to control the approach permission signaling light to be turned on at a time of manned operation when an engine has been stopped or a lock valve that switches an action of the construction machine between permission and prohibition is at an interrupting position, and when it is decided that approach of the worker to the construction machine can be tolerated according to information collected by the machine controller, and also control the action request signaling light to be turned on after switching the lock valve to the interrupting position at a time of unmanned operation when it is decided that it is necessary to request a nearby worker to take a particular action or when a signal requesting a nearby worker to take a particular action is received via the communication terminal.

Advantages of the Invention

The present invention makes it possible to succinctly notify nearby workers and a manager of a machine-body action state, and to realize both the safety and work efficiency of the workers and the manager near the machine body.

BRIEF DESCRIPTION OF THE DRAWINGS

FIG. 3 is a figure depicting the relation among a name, a display color, and use (lighting condition) of each state signaling light.

FIG. 5 is a figure depicting, in each control state, the relation between permission and prohibition of machine-body operation by a riding operator and permission and prohibition of machine-body operation by remote (outside) commands.

FIG. 7 is a figure depicting a control table for a control pattern (lighting control pattern 1) of the state signaling lights in the manned operation state.

FIG. 8 is a figure depicting a control table for a control pattern (lighting control pattern 2) of the state signaling lights in the manned operation state.

FIG. 9 is a figure depicting a control table for a control pattern (lighting control pattern 3) of the state signaling lights in the manned operation state.

FIG. 10 is a figure depicting a control table for an unmanned operation state.

MODE FOR CARRYING OUT THE INVENTION

Hereinbelow, an embodiment of the present invention is explained with reference to FIG. 1 to FIG. 10.

Note that whereas a hydraulic excavator equipped with a front work implement is illustrated as an example of a construction machine in explanation of the present embodiment, the present invention can be applied also to other construction machines.

Figure 1:
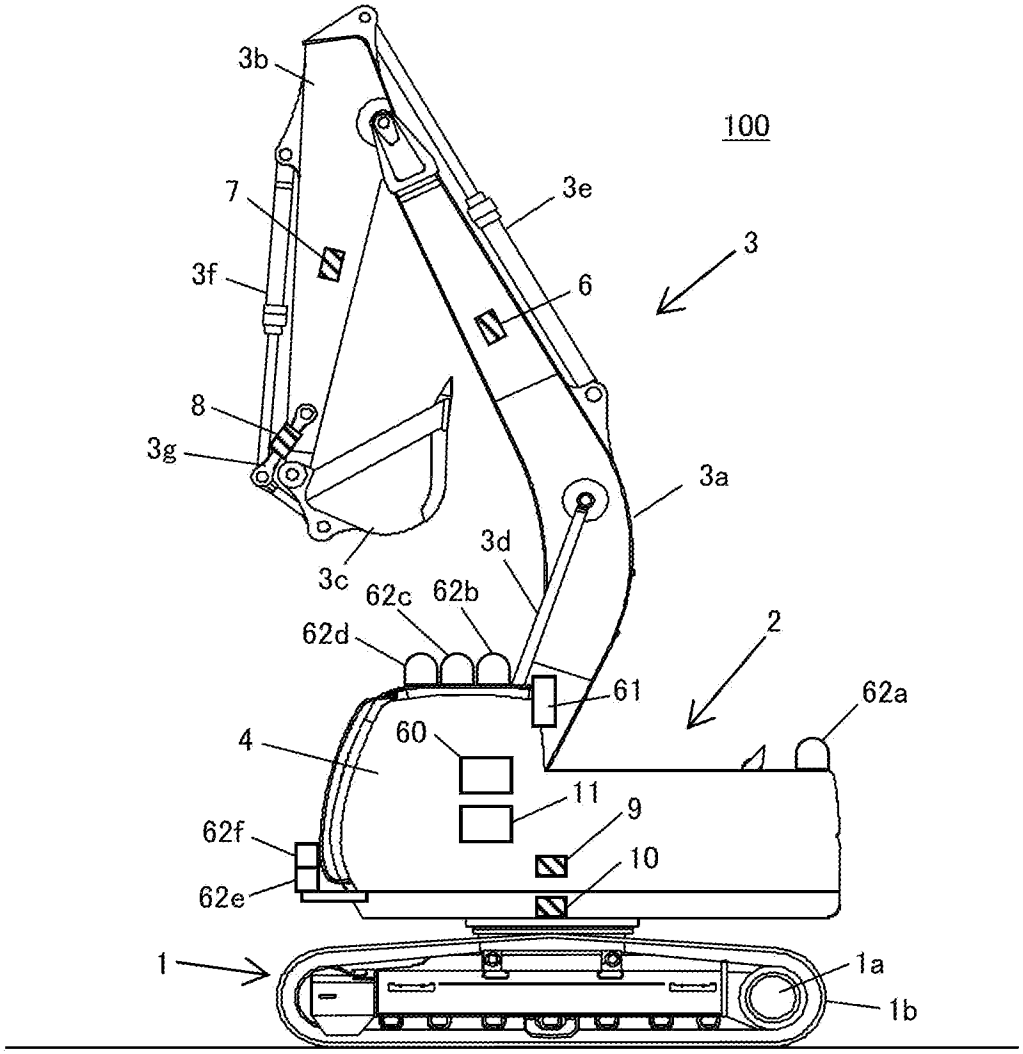
FIG. 1 is a side view schematically depicting the external appearance of a hydraulic excavator which is an example of a construction machine.

FIG. 1 is a side view schematically depicting the external appearance of a hydraulic excavator which is an example of a construction machine according to the present embodiment. In addition, FIG. 2 is a functional block diagram depicting a hydraulic system and a control system of the construction machine that are extracted along with related configuration.

In FIG. 1, a hydraulic excavator 100 generally includes: a crawler-type lower travel structure 1; an upper swing structure 2 provided swingably relative to the lower travel structure 1; a front work implement 3 provided vertically-pivotably relative to the upper swing structure 2; and an operation room 4 provided to the front upper portion of the upper swing structure 2 for an operator (operator) to ride in and perform various types of operation of the hydraulic excavator 100. The lower travel structure 1 and the upper swing structure 2 are included in the machine body of the hydraulic excavator 100.

The lower travel structure 1 includes: a pair of left and right travel hydraulic motors 1*a* which are hydraulic actuators; and crawlers 1*b* wrapped around the travel hydraulic motors 1*a* in the front-back direction. The lower travel structure 1 performs forward or backward travel actions by rotation-driving each of the crawlers 1*b* independently by a corresponding one of the travel hydraulic motors 1*a* via a deceleration mechanism or the like which is not depicted.

Figure 2:
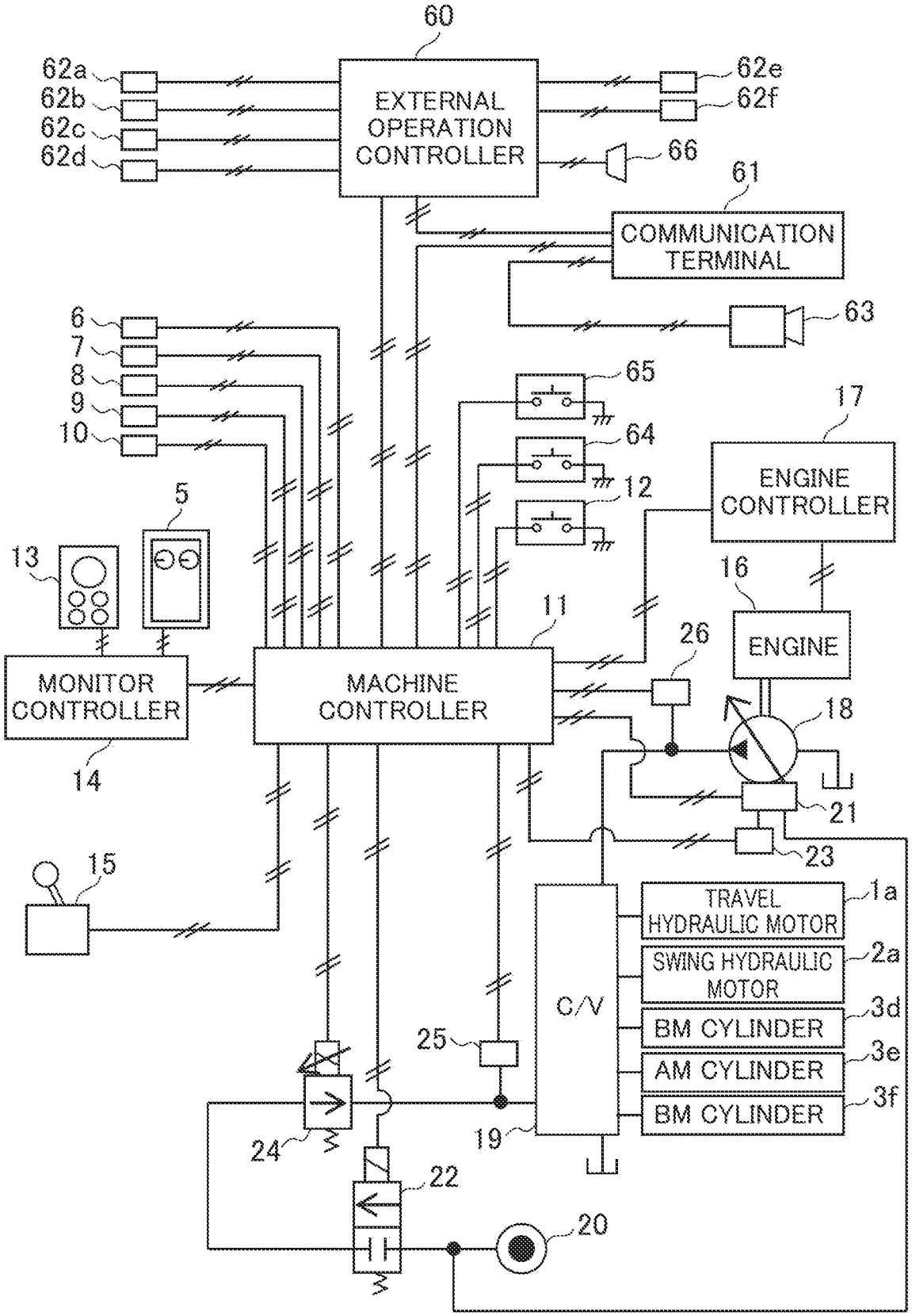
FIG. 2 is a functional block diagram depicting a hydraulic system and a control system of the construction machine that are extracted along with related configuration.

The upper swing structure 2 includes a hydraulic system of the hydraulic excavator 100 including a prime mover such as an engine 16, a hydraulic pump 18, and a swing hydraulic motor 2*a*, and related mechanisms thereof (see FIG. 2). The upper swing structure 2 performs right or left swinging actions relative to the lower travel structure 1 by the swing hydraulic motor 2*a* which is a hydraulic actuator.

A front work implement 30 is an articulated-type device that includes a plurality of front implement members (a boom 3*a*, an arm 3*b*, and a bucket (work device) 3*c*) that are coupled with each other such that each of them pivots vertically. The base end of the boom 3*a* is supported vertically pivotably by the front portion of the upper swing structure 2, one end of the arm 3*b* is supported vertically pivotably by an end portion (end) of the boom 3*a* which is different from the base end, and the bucket 3*c* as a work device is supported vertically pivotably by the other end of the arm 3*b*. The boom 3*a*, the arm 3*b*, and the bucket 3*c* are pivot-driven by a boom cylinder 3*d*, an arm cylinder 3*e*, and a bucket cylinder 3*f*, respectively, which are hydraulic actuators.

The front work implement 3 is provided with an angle sensor 6 (boom-angle sensor) that senses an angle of the boom 3*a*, an angle sensor 7 (arm-angle sensor) that senses an angle of the arm 3*b*, and an angle sensor 8 (bucket angle sensor) that senses an angle of the bucket 3*c*. For example, the angle sensors 6, 7, and 8 are IMUs (Inertial Measurement Units: inertial measurement units), and relative angles of the boom 3*a*, the arm 3*b*, the bucket 3*c*, and the upper swing structure 2 can be computed on the basis of sensing results from the angle sensors 6 to 8.

In addition, an inclination sensor 9 that senses a front-back direction angle (pitch angle) and left-right direction angle (roll angle) of the machine body is attached to the frame of the upper swing structure 2, and a swing angle sensor 10 that senses a relative angle (swing angle) of the upper swing structure 2 relative to the lower travel structure 1 is attached to a center joint (not depicted) linking the lower travel structure 1 and the upper swing structure 2 to each other. The inclination sensor 9 is an acceleration sensor, an IMU, or the like.

A display device 5 such as a liquid crystal monitor on which various types of meter and body information are displayed is provided inside the operation room 4 such that an operator can check the situation of the hydraulic excavator 100.

A machine controller 11 that controls the overall action of the hydraulic excavator 100 is mounted inside the operation room 4, and the machine controller 11 has a functionality for inputting signals of various types of sensor for deciding actions of the hydraulic excavator, a signal output functionality for driving the pump, control valves, and the like, and a functionality for communication with other vehicle-mounted controllers such as an engine controller.

The angle sensors 6, 7, and 8, the inclination sensor 9, and the swing angle sensor 10 are electrically connected to the machine controller 11. The machine controller 11 uses information about these various types of sensor for posture computation to compute the posture of the hydraulic excavator (angles of the boom 3*a*, the arm 3*b*, and the bucket 3*c* relative to the ground, and a relative angle between the lower travel structure 1 and the upper swing structure 2), uses the computed posture for a machine control functionality or an area limitation functionality, uses the computed posture for remote operation or automated operation, and so on.

In addition, in the operation room 4 of the hydraulic excavator 100, an external operation controller 60 that transmits requests to drive the pump, control valves, and the like to the machine controller 11 at a time of unmanned operation such as remote operation or automated operation is provided. The machine controller 11, which receives such a drive request signal, driving the pump, control valves, or the like at a time of unmanned operation makes it possible to drive a hydraulic actuator (the boom cylinder 3*d*, the arm cylinder 3*e*, the bucket cylinder 3*f*, the travel hydraulic motor 1*a*, the swing hydraulic motor 2*a*, etc.) of the hydraulic excavator 100 even when an operation device 15 is not being operated by a riding operator.

A communication terminal 61 for communication with the outside at a time of unmanned operation is provided outside the operation room 4 of the hydraulic excavator 100, and makes it possible to mutually communicate with a worker communication terminal (not depicted) carried by a nearby worker, a remote operation apparatus (not depicted) operated by a remote operation operator, and a control room (not depicted) at which the machine-body state is monitored remotely, the machine-body action is operated remotely, and so on.

State signaling lights 62*a*, 62*b*, 62*c*, 62*d*, 62*e*, and 62*f* as signaling devices for notifying nearby workers of the machine-body state are provided to the hydraulic excavator 100. The state signaling lights 62*a*, 62*b*, 62*c*, 62*d*, 62*e*, and 62*f* are each a rotating light of a single color. Hereinafter, a plurality of the state signaling lights 62*a*, 62*b*, 62*c*, 62*d*, 62*e*, and 62*f* are described collectively as state signaling lights 62 in some cases.

FIG. 3 is a figure depicting the relation among a name, a display color, and use (lighting condition) of each state signaling light. FIG. 3 depicts the relation among a state signaling light's name 201, a display color 202, and use (lighting condition) 203 of each of state signaling lights' names 201*a* to 201*f* in a table format.

The state signaling lights 62 provided to the hydraulic excavator 100 include:

- the state signaling light 62*a* (hereinafter, referred to as a work signaling light 62*a*) which is given the name "work signaling light" (name 201*a*);
- the state signaling light 62*b* (hereinafter, referred to as a warning signaling light 62*b*) which is given the name "warning signaling light" (name 201*b*);
- the state signaling light 62*c* (hereinafter, referred to as a communication signaling light 62*c*) which is given the name "communication signaling light" (name 201*c*);
- the state signaling light 62*d* (hereinafter, referred to as an operation signaling light 62*d*) which is given the name "operation signaling light" (name 201*d*);
- the state signaling light 62*e* (hereinafter, referred to as an approach permission signaling light 62*e*) which is given the name "approach permission signaling light" (name 201*e*); and the state signaling light 62*f* (hereinafter, referred to as an action request signaling light 62*f*) which is given the name "action request signaling light" (name 201*f*).

Yellow is adopted for the work signaling light 62*a* in order to notify nearby workers that the machine body is in operation and to call their attention.

Red is adopted for the warning signaling light 62*b* in order to notify that an anomaly or a malfunction occurs or the machine body is in a state of emergency.

Blue is adopted for the communication signaling light 62*c* as one of colors to represent an ordinary state.

Green is adopted for the operation signaling light 62*d* as a color to represent the normal state.

Green is adopted for the approach permission signaling light 62*e* as a color to represent a safe state where approach of nearby workers to the machine body is permitted.

Blue is adopted for the action request signaling light 62*f* as a color for requesting a nearby worker to approach the machine body (forcing a nearby worker to take an action).

There is a lot of information that is desired to be notified from the machine body to a manager of unmanned operation or nearby workers as described above. However, since ease of recognition deteriorates if there are too many colors to be used, and so on, it would be better to avoid an unnecessary increase the kinds of colors to be used.

In addition, where text is displayed on a liquid crystal panel or the like, more accurate information can be conveyed, but, on the other hand, this causes concern that it takes long for a worker to recognize the content, directions from where the information can be visually recognized are limited, and so on.

In the present embodiment, four colors, red, yellow, blue, and green, which are colors used typically for industrial machines are used. Regarding meanings allocated to the colors also, green is allocated to mean "normal" or "permitted," and blue is allocated to mean an "instruction (approach request") to a nearby worker. Accordingly, misinterpretation, confusion, and the like regarding the meanings are unlikely to occur.

Regarding mounting positions of the respective state signaling lights 62 also, they are arranged in the following manner taking into consideration suppression of misinterpretation, confusion, and the like of meanings.

The work signaling light 62*a* is arranged on a counter weight near the rear end periphery of the upper swing structure such that it can be visually noticed easily by nearby workers during operation.

Since the notification by the warning signaling light 62*b*, the communication signaling light 62*c*, and the operation signaling light 62*d* is mainly aimed for a manager who monitors remote operation or automated operation, they are arranged on the upper surface of the operation room such that they are visually easily recognizable from a location far away from the machine body or a location higher than the machine body.

Since the notification by the approach permission signaling light 62*e* and the action request signaling light 62*f* is mainly aimed for workers near the machine body, particularly workers close to the machine body, these signaling lights are arranged at a location which is on the front left side of the operation room and close to the open/close door handle of the door of the operation room 4 such that they are visually easily recognizable from a location close to the machine body or the height of the lines of sight of workers.

Three state signaling lights 62, the warning signaling light 62*b*, the communication signaling light 62*c*, and the operation signaling light 62*d*, are arranged close to each other, that is, arranged such that they are adjacent to each other to form one group. In addition, two state signaling lights 62 of the approach permission signaling light 62*e* and the action request signaling light 62*f* are arranged close to each other, that is, arranged such that they are adjacent to each other to form one group. In addition, the group of the warning signaling light 62*b*, communication signaling light 62*c*, and operation signaling light 62*d*, and the group of the approach permission signaling light 62*e* and the action request signaling light 62*f* are arranged at a distance. By arranging them in this manner, it is possible to prevent workers for whom the notification of information by the respective state signaling lights 62 is aimed from getting confused about meanings when they visually recognize the state signaling lights 62.

Furthermore, the green state signaling light representing the "normal" operation state of the machine body and the green state signaling light representing "permission" to approach the machine body are arranged at a distance from each other such that even if they are state signaling lights that use the same color, a manager of unmanned operation and nearby workers for whom the notification by these signaling lights is aimed are prevented from getting confused about meanings. In addition, the state signaling lights whose notification is aimed for a manager of unmanned operation are arranged above the operation room, and the state signaling lights whose notification is aimed for nearby workers are arranged below the operation room, thereby making it easier for a state signaling light representing information necessary for a person for whom the notification is aimed to be seen in the visual field of the person.

Furthermore, by arranging, at adjacent positions, the approach permission signaling light 62*e* and the action request signaling light 62*f* whose notification is aimed for nearby workers, it is made easier to recognize that these two represent notification content aimed for nearby workers.

In addition, safety and work efficiency can be enhanced further by applying such devices as follows.

Preferably, the operation signaling light 62*d* is arranged at such a position that a riding operator cannot visually recognize it from the inside of the cab, and the approach permission signaling light 62*e* is arranged at such a position that the riding operator can visually recognize it from the inside of the cab, and additionally nearby workers located outside the cab and close to the operation room can visually recognize it.

Since, in this case, only the approach permission signaling light 62*e* in the operation signaling light 62*d* and approach permission signaling light 62*e*, which are signaling lights of the same color, green, is seen in the visual field of the riding operator in the operation room 4, it is possible to enhance the ease of recognition that the machine body is in an approach permitted state (a state where it is likely that a nearby worker approaches the machine body) when the operator is riding in the excavator 100, and the safety can be enhanced.

In addition, since an operator can check lighting of the approach permission signaling light 62*e* while riding in the excavator 100, she/he can check whether the approach permission signaling light 62*e* is functioning normally from the inside of the operation room.

In addition, preferably, the approach permission signaling light 62*e* is installed at such a position that nearby workers who visually recognize the approach permission signaling light 62*e* can be seen in the visual field of a riding operator in the operation room 4.

In a case where it is determined as a rule of a work site that approach is permitted only when the approach permission signaling light 62*e* is turned on, nearby workers get into a habit of checking the lighting state of the approach permission signaling light 62*e* first before they approach the machine body. Therefore, by making a position where the approach permission signaling light 62*e* can be visually seen be included in the visual field of a riding operator in the operation room 4, a nearby worker who is approaching the machine body is allowed to be came into the visual field of the riding operator in the operation room 4 as early as possible. Thus, it is possible to suppress the possibility of approach of a worker from such a direction as from the rear right side of the machine body, from which direction recognizing visually the worker is difficult for the riding operator in the operation room 4, and the safety of the work site can be enhanced.

By devising the arrangement and display colors of the respective state signaling lights 62 as mentioned above, it becomes possible for workers near the machine body and a worker (a managing/monitoring worker of the machine body) who is far away from the machine body to recognize respectively necessary information without misinterpretation, and the safety and work efficiency of the workers can be enhanced.

As depicted in FIG. 2, the hydraulic excavator 100 includes: the machine controller 11 that controls the overall action of the body; a lock switch 12 that is a lever-type switch for switching action lock means that switches all actions of the machine body between permission and prohibition; the display device 5 on which various types of meter and body information are displayed such that an operator can check the situation of the hydraulic excavator; a switch box 13 for manually changing the engine rotation speed, operating the display device 5, and so on; and a monitor controller 14 that accepts various types of switch input from the switch box 13, and changes the display content of the display device 5. The machine controller 11, the lock switch 12, the display device 5, the switch box 13, and the monitor controller 14 are provided inside the operation room 4.

In addition, the operation device 15 for performing various types of operation of the hydraulic excavator is provided in the operation room 4 of the hydraulic excavator 100. For example, the operation device 15 is a plurality of operation levers for performing boom-raising operation, boom-lowering operation, arm-crowding operation, arm-dumping operation, bucket-crowding operation, bucket-dumping operation, left swing operation, right swing operation, right forward travel operation, right backward travel operation, left forward travel operation, left backward travel operation, and the like.

The hydraulic excavator 100 has, as a prime mover, the engine 16 mounted thereon, and an engine controller 17 electrically connected with the engine 16 controls the rotation speed and torque of the engine by grasping the state of the engine 16 from signals of a temperature sensor or a pickup incorporated into the engine and controlling valves or the like.

The machine controller 11, the monitor controller 14, and the engine controller 17 are connected to each other by CAN communication, and each of them transmits and receives necessary information.

For example, regarding engine rotation speed control, the machine controller 11 computes an engine target rotation speed according to a control voltage set by an engine control dial and then output, the operation state of the operation device 15, the state of load on the hydraulic pump 18, the temperature condition, or the like, and transmits the computed engine target rotation speed to the engine controller 17. The engine controller 17 controls the engine 16 such that its engine rotation becomes the engine target rotation speed computed at the machine controller 11, and also the engine controller 17 computes the engine actual rotation speed from a signal of a pickup sensor built in the engine 16, and transmits the engine actual rotation speed to the machine controller 11. The monitor controller 14 acquires the engine target rotation speed and engine actual rotation speed on the CAN communication, and displays, on the display device 5, information such as the acquired engine target rotation speed or engine actual rotation speed as one pieces of machine-body state display information.

A hydraulic working fluid delivered from the variable-displacement hydraulic pump 18 driven by the engine 16 is supplied to the travel hydraulic motor 1*a*, the swing hydraulic motor 2*a*, the boom cylinder 3*d*, the arm cylinder 3*e*, and the bucket cylinder 3*f* via a control valve 19 that controls the flow of a hydraulic fluid to each of hydraulic actuators 1*a*, 2*a*, 3*d*, 3*e*, and 3*f*.

Note that whereas the present embodiment illustrates a case where the one hydraulic pump 18 is included, a plurality of hydraulic pumps may be mounted taking into consideration a situation where a plurality of actuators are operated simultaneous, or the like, in other possible configuration.

The operation device 15 is an electric operation lever, and outputs a PWM output signal (operation signal) according to an operation amount to the machine controller 11.

A pilot pump 20 which is the hydraulic fluid source, is driven by the engine 16, and a delivery pressure from the pilot pump 20 is supplied to a pump regulator 21 and a lock valve 22 which is action lock means. The delivery pressure from the pilot pump 20 is kept at a pilot primary pressure (e.g. 4 MPa) by a pilot relief valve which is not depicted.

The pump regulator 21 includes a pump flow rate control solenoid valve which is a solenoid proportional valve that reduces for use the pilot primary pressure from the pilot pump 20, and generates a pump flow rate control pressure (secondary pressure) by reducing the pilot primary pressure according to a command current output by the machine controller 11. In addition, the pump regulator 21 includes a control mechanism that controls the tilting (displacement) of the hydraulic pump 18, and controls the volume, that is, the delivery flow rate, of the hydraulic pump 18 according to output (a pump flow rate control pressure) of the pump flow rate control solenoid valve.

The pump regulator 21 performs control, in terms of characteristics of the hydraulic pump 18, such that with the minimum pump flow rate control pressure (e.g. 0 MPa), the pump displacement becomes the minimum, and with the maximum pump flow rate control pressure (e.g. 4 MPa), the pump displacement becomes the maximum. The pump flow rate control solenoid valve is at the interrupting position (e.g. 0 MPa) in a no-control state (e.g. 0 mA), and is controlled such that the pump flow rate control pressure increases as a command current from the machine controller 11 increases.

The pump regulator 21 is provided with a pump flow rate control pressure sensor 23 for sensing the pump flow rate control pressure. The pump flow rate control pressure sensed by the pump flow rate control pressure sensor 23 is input, as a sensing signal, to the machine controller 11. The machine controller 11, using the relation retained in advance between the pump flow rate control pressure and the pump displacement, estimates the pump displacement on the basis of the pump flow rate control pressure sensed by the pump flow rate control pressure sensor 23, and computes the delivery flow rate of the hydraulic pump 18 by multiplying the estimated pump displacement and an engine rotation speed.

The lock valve 22 is action lock means for switching all actions of the machine body between permission and prohibition. The lock valve 22 is switched to the interrupting position and the communicating position by a solenoid that is driven by the machine controller 11.

The lock switch 12 is in the OFF state (terminals are disconnected) when a lock lever (not depicted) installed in the operation room 4 is at the lock position. The machine controller 11 monitors the state of the lock switch 12, and switches the lock valve 22 to the interrupting position in a non-excited state when the lock switch 12 is at the OFF position.

In addition, the lock switch 12 is in the ON state (terminals are conductively connected) when the lock lever is at the unlocking position. The machine controller 11 monitors the state of the lock switch 12, and switches the lock valve 22 to the communicating position in an excitation state by applying a control voltage (e.g. 24 V) to the lock valve 22 when the lock switch 12 is at the ON position.

A pilot circuit between the lock valve 22 and the control valve 19 is provided with a pilot pressure control reducing valve 24. The machine controller 11 drives the pilot pressure control reducing valve 24 according to a lever operation amount which is an input signal of the operation device 15.

The pilot primary pressure is supplied to the pilot pressure control reducing valve 24 when the lock valve 22 is at the communicating position, and when the pilot operation pressure is generated by the pilot pressure control reducing valve 24, the generated pilot operation pressure moves a plurality of spools (directional control valves) in the control valve 19. Thus, the flow of the hydraulic working fluid delivered from the hydraulic pump 18 is adjusted, and this enables actions of the corresponding hydraulic actuators 1*a*, 2*a*, 3*d*, 3*e*, and 3*f*.

Since the pilot primary pressure is not supplied to the pilot pressure control reducing valve 24 when the lock valve 22 is at the interrupting position, the pilot operation pressure also is no longer generated (e.g. becomes 0 MPa), and this disables actions of the hydraulic actuators 1*a*, 2*a*, 3*d*, 3*e*, and 3*f*.

That is, depending on the position of the lock lever (not depicted) installed in the operation room 4, all actions of the machine body are switched to permission or prohibition. Specifically, all actions of the machine body are prohibited when the lock lever is at the lock position, and machine-body actions are tolerated when the lock lever is at the unlocking position.

A pilot circuit between the pilot pressure control reducing valve 24 and the control valve 19 is provided with an operation pressure sensor 25 for sensing the pilot operation pressure.

A sensing signal of the operation pressure sensor 25 is input to the machine controller 11. The machine controller 11 can grasp the operational situation of the hydraulic excavator 100 and whether or not the pilot pressure control reducing valve 24 is functioning normally on the basis of the pilot operation pressure sensed by the operation pressure sensor 25.

A delivery circuit between the hydraulic pump 18 and the control valve 19 is provided with a pump delivery pressure sensor 26 for sensing the pump delivery pressure. The machine controller 11 can grasp the pump load of the hydraulic pump 18 of the hydraulic excavator 100 on the basis of the pump delivery pressure sensed by the pump delivery pressure sensor 26.

The machine controller 11, according to the engine rotation speed or input of the operation device 15, computes a pump target flow rate according to the operation. In addition, the machine controller 11 computes a limited horsepower according to the engine rotation speed, the operational situation, or other machine-body states (the temperature, etc.), and computes a pump-flow-rate upper limit according to the horsepower limit from input of the pump delivery pressure sensor 26 and the limited horsepower. The machine controller 11 selects, as the pump target flow rate, a smaller one of the pump target flow rate according to the operation and the pump-flow-rate upper limit according to the horsepower limit, and drives the pump flow rate control solenoid valve such that the delivery flow rate of the hydraulic pump 18 becomes the pump target flow rate.

The communication terminal 61 receives a command signal for performing unmanned operation such as remote operation or automated operation from the outside of the machine body, and also transmits the machine-body posture or various types of state information to the outside.

The communication terminal 61 is connected with the external operation controller 60 by the CAN communication. In addition, the external operation controller 60 and the machine controller 11 also are connected with each other by the CAN communication. At a time of unmanned operation (remote operation, automated operation) of the hydraulic excavator 100, the external operation controller 60 executes actuator actions or actuation of the pump and valves at a time of the unmanned operation by passing an operation command received from the outside via the communication terminal 61 to the machine controller 11.

In addition, the external operation controller 60 can grasp the states of various types of switch and various types of sensor connected to the machine controller 11 by the CAN communication connecting the external operation controller 60 and the machine controller 11 with each other.

In addition, the communication terminal 61 is connected not only with the external operation controller 60, but also with the machine controller 11 by the CAN communication, and can transmit, to the remote operation apparatus or the control room through a network, various types of state information (the temperature, engine rotation speed, postural information, etc.) about the machine body received from the machine controller 11.

In addition, the communication terminal 61 is configured to be able to send a command also to the monitor controller 14 through the machine controller 11, and can cause a monitor (the display device 5) to display a particular message, icon or the like in accordance with a command from a remote location.

In addition, the communication terminal 61 is connected with a plurality of vehicle-mounted cameras 63 by Ethernet communication, and videos of images around the machine body can be checked even from a remote location by causing a communication terminal to transmit video signals of the plurality of cameras 63 through a network.

The external operation controller 60 is electrically connected with six types of rotating light, the work signaling light 62*a*, the warning signaling light 62*b*, the communication signaling light 62*c*, the operation signaling light 62*d*, the approach permission signaling light 62*e*, and the action request signaling light 62*f*, as state signaling lights for notifying nearby workers of the machine-body state, and the six types of rotating light are switched between on (ON) and off (OFF) in accordance with a command of the external operation controller 60.

In addition, the external operation controller 60 is connected with an external speaker 66 (notifying device) for notifying nearby workers of an audio message or a warning sound related to unmanned operation, and the external speaker 66 outputs a notification sound in accordance with a command of the external operation controller 60.

An operation state selector switch 64 for switching between manned operation and unmanned operation is mounted in the operation room 4 of the hydraulic excavator 100, and is electrically connected with the machine controller 11. The operation state selector switch 64 is a so-called momentary switch, and the machine controller 11 can assess whether the operation state selector switch 64 is being pressed (ON) or not being pressed (OFF).

In addition, a lighting condition selector switch 65 that allows a riding operator to change (switch) lighting conditions of the state signaling lights 62 is mounted in the operation room 4 of the hydraulic excavator 100, and is electrically connected with the machine controller 11. The lighting condition selector switch 65 is a so-called momentary switch, and the machine controller 11 can assess whether the lighting condition selector switch 65 is being pressed (ON) or not being pressed (OFF).

Although not depicted here, each of the machine controller 11, the monitor controller 14, the engine controller 17, and the external operation controller 60 is configured by a central processing unit (CPU), a memory, and an interface. The central processing unit (CPU) executes a program stored in advance in the memory, the central processing unit (CPU) performs processes on the basis of setting values stored in the memory and signals input from the interface, and the interface outputs signals.

Figure 4:
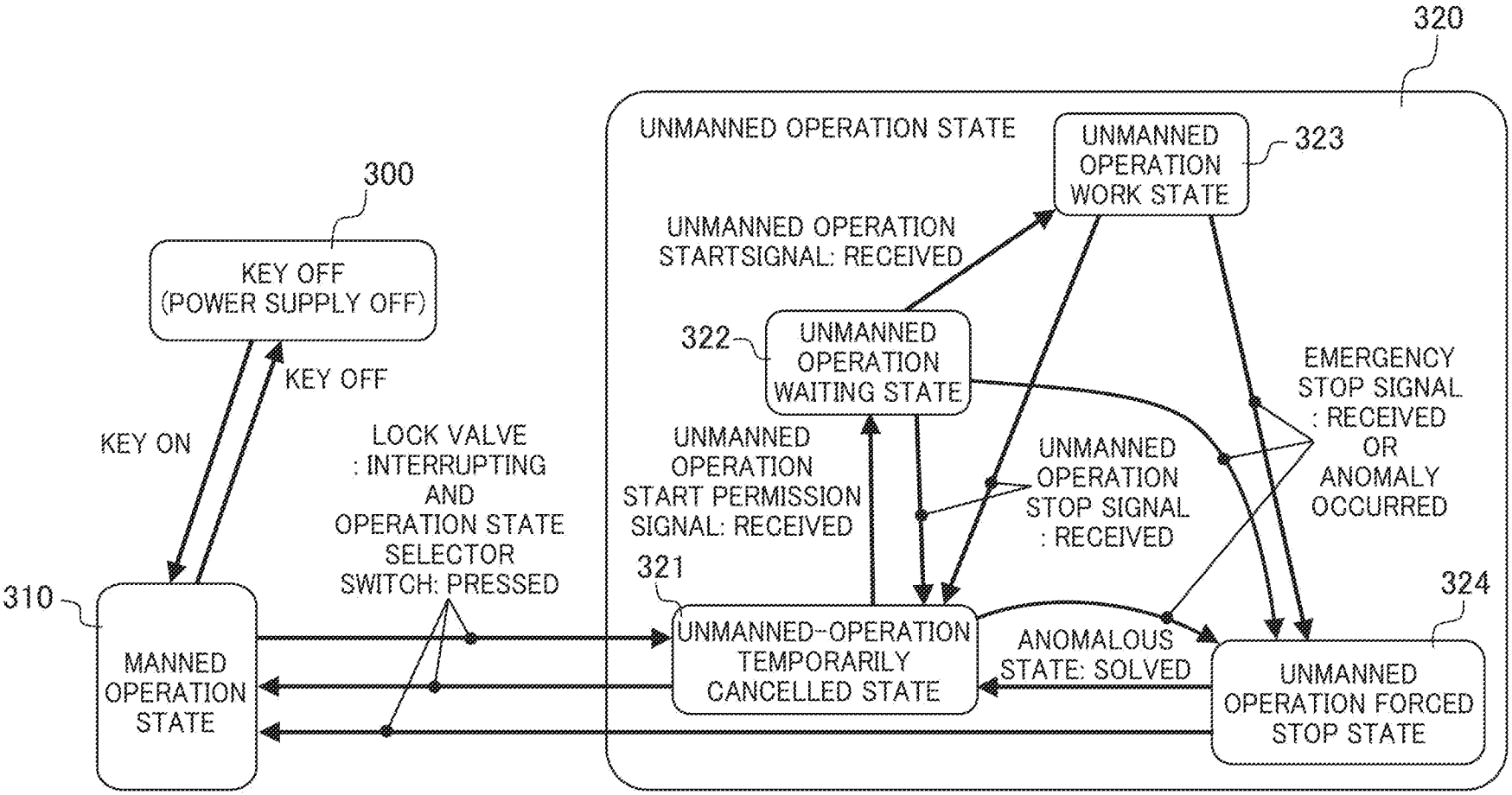
FIG. 4 is a figure depicting state transitions of the machine-body control state of the hydraulic excavator.

FIG. 4 is a figure depicting state transitions of the machine-body control state of the hydraulic excavator. In addition, FIG. 5 is a figure depicting the relation between permission and prohibition of machine-body operation by a riding operator and permission and prohibition of machine-body operation by remote (outside) commands in each control state depicted in FIG. 4. FIG. 5 depicts the relation among a control state 211, permission and prohibition of machine-body operation by the riding operator 212, and permission and prohibition of machine-body operation by remote (outside) commands 213 for each control state in a table format.

Here, machine-body operation is all types of operation other than operation equivalent to ON/OFF operation of an activation key of the hydraulic excavator 100 and pressing operation of the operation state selector switch 64, and includes operation such as activation/stop of the engine 16, interruption/unlocking of the lock valve 22, actions of the hydraulic actuators 1*a*, 2*a*, 3*d*, 3*e*, and 3*f*, operation of other electrical components, and changes in setting of the machine body.

If key ON operation is performed by the riding operator in the operation room 4 in a key OFF (power supply OFF) state 300 of the hydraulic excavator 100, the machine controller 11 and the external operation controller 60 transition to a manned operation state 310.

The manned operation state 310 is a state where the hydraulic excavator 100 is actuated by manual operation. As depicted in FIG. 5, in the manned operation state 310, machine-body operation by the riding operator in the operation room 4 is enabled; on the other hand, machine-body operation by remote (outside) commands is disabled.

If the riding operator in the operation room 4 presses the operation state selector switch 64 when the lock valve 22 is in the interrupting state in the manned operation state 310, the machine controller 11 and the external operation controller 60 transition to an unmanned-operation temporarily cancelled state 321 which is a part of an unmanned operation state 320.

In addition, if the riding operator in the operation room 4 presses the operation state selector switch 64 when the lock valve 22 is in the interrupting state in the unmanned-operation temporarily cancelled state 321 in the unmanned operation state 320, the machine controller 11 and the external operation controller 60 transition to the manned operation state 310.

Here, the interrupting state of the lock valve 22 is included in conditions regarding the state transition between the manned operation state 310 and the unmanned operation state 320, in order to ensure that switching of the control state between manned operation and unmanned operation is necessarily performed in a state where the machine body is stopped (i.e. a state where the hydraulic actuators 1*a*, 2*a*, 3*d*, 3*e*, and 3*f* are not in action), and to prevent undesirable unintended rapid movement of the machine body at a time of switching of the control state.

Here, in the present embodiment, at a work site where the construction machine (hydraulic excavator 100) capable of unmanned operation is operating, all workers carry communication terminals (worker communication terminals: e.g. wrist-watch type wearable terminals) that are capable of network connection. The worker communication terminals, the construction machine (hydraulic excavator 100), and the control room that manages/monitors unmanned operation are connected to the same network, and the respective units of equipment can exchange data by mutual communication.

As depicted in FIG. 5, in the unmanned-operation temporarily cancelled state 321, machine-body operation by the riding operator in the operation room 4 is enabled; on the other hand, machine-body operation by remote (outside) commands is disabled.

In the unmanned-operation temporarily cancelled state 321, the riding operator in the operation room 4 (the worker having pressed the operation state selector switch 64) checks safety around the machine body after moving out of the work range of the machine body, and operates her/his worker communication terminal to transmit an unmanned operation start permission signal to the machine body and the control room. When the hydraulic excavator 100 receives the unmanned operation start permission signal in the unmanned-operation temporarily cancelled state 321, the machine controller 11 and the external operation controller 60 transition to an unmanned operation waiting state 322.

The unmanned operation waiting state 322 is a state where remote operation can be started at any time depending on a determination on the control-room side. As depicted in FIG. 5, in the unmanned operation waiting state 322, machine-body operation by the riding operator in the operation room 4 (operation of levers or switches in the operation room 4) becomes disabled. In addition, machine-body operation by remote (outside) commands is disabled.

In the unmanned operation waiting state 322, when the unmanned operation state 320 is ended, and the control state returns to the manned operation state 310, an unmanned operation stop signal is transmitted from a worker communication terminal or the control room to the hydraulic excavator 100. If the hydraulic excavator 100 receives the unmanned operation stop signal when the control state is the unmanned operation waiting state 322, the machine controller 11 and the external operation controller 60 transition to the unmanned-operation temporarily cancelled state 321. Accordingly, by the riding operator in the operation room 4 pressing the operation state selector switch 64 when the lock valve 22 is in the interrupting state, it is possible to cause the machine controller 11 and the external operation controller 60 to transition to the manned operation state 310.

If the control room transmits an unmanned operation start signal to the hydraulic excavator 100, and the hydraulic excavator 100 receives the unmanned operation start signal in the unmanned operation waiting state 322, the machine controller 11 and the external operation controller 60 transition to an unmanned operation work state 323.

As depicted in FIG. 5, in the unmanned operation work state 323, machine-body operation by the riding operator in the operation room 4 (operation of levers or switches in the operation room) is disabled, and all types of operation are possible only by remote (outside) commands.

In this manner, the present embodiment is set such that transitions occur from the unmanned-operation temporarily cancelled state 321 through the unmanned operation waiting state 322 to the unmanned operation work state 323. That is, the present embodiment is set such that in order to transition to the unmanned operation work state 323 in which machine-body operation by remote (outside) commands is enabled, it is necessary to check intensions of both a worker near the machine body and the control room, which intensions include transmission of the unmanned operation start permission signal with a worker communication terminal. By setting the procedure of state transitions in this manner, it is possible to prevent occurrence of unmanned operation work (machine-body actions) at a timing not intended by a nearby worker or at a timing when the safety of nearby workers cannot to be checked, and the safety can be enhanced.

When machine-body operation is performed temporarily by the riding operator in the operation room 4, the control state returns to the manned operation state 310, and so on during work in the unmanned operation work state 323, if the control room transmits the unmanned operation stop signal to the hydraulic excavator 100, and the hydraulic excavator 100 receives the unmanned operation stop signal, the machine controller 11 and the external operation controller 60 transition to the unmanned-operation temporarily cancelled state 321.

Note that it is desirable if transmission of the unmanned operation stop signal in the unmanned operation work state 323 by a worker communication terminal is disabled (or in the unmanned operation work state 323, the unmanned operation stop signal from a worker communication terminal is not accepted at the machine controller 11 or the external operation controller 60 on the machine-body side). This makes the work efficiency of unmanned operation be enhanced without stopping the unmanned operation carelessly during work by the unmanned operation.

When a nearby worker requests to temporarily stop unmanned operation in the unmanned operation work state 323, the worker transmits an unmanned operation stop request to the control room by operating her/his worker communication terminal. The managing/monitoring worker who is in the control room having received the unmanned operation stop request actuates the machine body until some stopping point of work comes, causes the machine body to assume an appropriate stopping posture, and then transmits the unmanned operation stop signal to the machine body. The machine body having received the unmanned operation stop signal transitions to the unmanned-operation temporarily cancelled state 321. Since the unmanned operation can be stopped normally thereby, management of work processes of the unmanned operation can be performed, the work can be stopped safely, and the safety and work efficiency of the work site can be enhanced.

If the machine body receives an emergency stop signal that is sent when an emergency stop switch (not depicted) is pressed or an emergency stop signal that is transmitted through a network in the unmanned-operation temporarily cancelled state 321, the unmanned operation waiting state 322, or the unmanned operation work state 323, the machine controller 11 and the external operation controller 60 transition to an unmanned operation forced stop state 324. Note that also when the machine controller 11 or the external operation controller 60 decides that an anomaly that can disrupt continuation of unmanned operation has occurred in the unmanned-operation temporarily cancelled state 321, the unmanned operation waiting state 322, or the unmanned operation work state 323, similarly, the control state transitions to the unmanned operation forced stop state 324.

Preferably, behavior of the machine body in the unmanned operation forced stop state 324 is set for each event occurring according to the severity of the event.

For example, when it is determined that continuation of operation of the engine 16 causes a dangerous situation, it is conceivable that the engine 16 is stopped automatically. In addition, in a case of such a severity that the front posture is a posture out of the normal range undesirably, actions of the hydraulic actuators 1*a*, 2*a*, 3*d*, 3*e*, and 3*f* may be simply stopped.

Regarding the manner of stopping the hydraulic actuators 1*a*, 2*a*, 3*d*, 3*e*, and 3*f*, it is conceivable that the hydraulic actuators 1*a*, 2*a*, 3*d*, 3*e*, and 3*f* are stopped promptly in a case where an emergency stop switch is pressed, for example. In addition, in a case of such a severity that network connection is interrupted undesirably, the influence of undesirable significant jolting of the machine body or a load due to emergency stop can be reduced, and the safety can be enhanced by stopping the hydraulic actuators 1*a*, 2*a*, 3*d*, 3*e*, and 3*f* gently by control on the machine-body side.

In addition, by causing the lock valve 22 to automatically switch to the locking state when the machine body is stopped, it is possible to prevent unintended operation that causes the machine body to move undesirably when a worker unintendedly touches a lever when she/he rides in thereafter.

As depicted in FIG. 5, since unmanned operation is stopped in the unmanned operation forced stop state 324, machine-body operation only by the riding operator in the operation room 4 (levers or switches in the operation room 4) is enabled.

If the riding operator in the operation room 4 presses the operation state selector switch 64 when the lock valve 22 is in the interrupting state in the unmanned operation forced stop state 324, the machine controller 11 and the external operation controller 60 transition to the manned operation state 310. Thus, for example, even where it becomes unable to perform unmanned operation due to occurrence of a problem in network connection, a worker can ride in the operation room 4 of the hydraulic excavator 100 and cause the machine body to withdraw.

In addition, when the machine controller 11 or the external operation controller 60 determines that an anomalous state is solved in the unmanned operation forced stop state 324, the control state automatically transitions to the unmanned-operation temporarily cancelled state 321.

Next, control of the state signaling lights by the external operation controller is explained.

Figure 6:
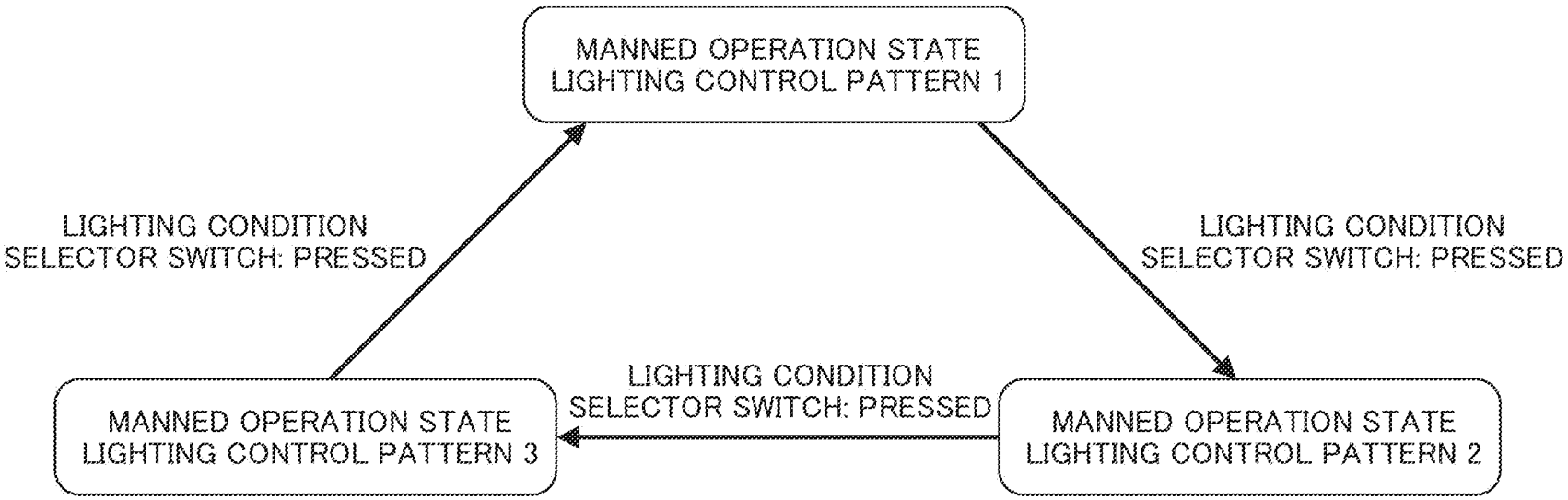
FIG. 6 is a figure depicting how it appears when control patterns of the state signaling lights are switched in a manned operation state.

FIG. 6 is a figure depicting how it appears when control patterns of the state signaling lights are switched in the manned operation state, FIG. 7 to FIG. 9 are figures depicting control tables for the control patterns. In addition, FIG. 10 is a figure depicting a control table for the unmanned operation state.

In the control tables depicted in FIG. 7 to FIG. 10, for each state signaling light (specifically, for each of the state signaling lights' names 221*a* to 221*f*), the relation among a state signaling light's name 221, a display color 222, and a lighting condition (a machine-body state when the state signaling light is turned on) 223 is set, and the control tables are stored on the external operation controller 60.

The external operation controller 60 controls ON and OFF of the state signaling lights 62. Lighting control of the state signaling lights 62 is generally classified into and switched between two manners of control including one performed at a time of the manned operation state 310 and the other performed at a time of the unmanned operation state 320. Furthermore, the lighting control at a time of the manned operation state 310 is switched among a "lighting control pattern 1" to a "lighting control pattern 3" every time the lighting condition selector switch 65 is pressed.

First, lighting control at a time of the manned operation state 310 is explained.

The external operation controller 60 retains three types of control table for the "lighting control pattern 1" (see FIG. 7), the "lighting control pattern 2" (see FIG. 8), and the "lighting control pattern 3" (see FIG. 9) as lighting control patterns of the state signaling lights 62 in the manned operation state 310. The control patterns switch in the order of the "lighting control pattern 1," the "lighting control pattern 2," the "lighting control pattern 3," and the "lighting control pattern 1" every time a riding operator in the operation room 4 presses the lighting condition selector switch 65. Note that the external operation controller 60 stores thereon a lighting control pattern that has been selected at a time of key OFF, and at the next time of key ON, reads out and uses the lighting control pattern that has been selected at the previous end time.

As depicted in FIG. 7, in the "lighting control pattern 1" in the manned operation state 310, the work signaling light 62*a* is turned on when the engine is in operation. This is for notifying nearby workers that the hydraulic excavator 100 is in operation.

The approach permission signaling light 62*e* is turned on when the engine is stopped or when the lock valve 22 is at the interrupting position. That is, the approach permission signaling light 62*e* is turned on when it is ensured that the machine body does not start moving.

Thus, when it is unavoidably necessary for a nearby worker to approach the machine body, the nearby worker can visually check whether a riding operator in the operation room 4 surely stops the machine body, and this enhances the safety at the work site.

The warning signaling light 62*b*, the communication signaling light 62*c*, the operation signaling light 62*d*, and the action request signaling light 62*f* are always turned off since they are state signaling lights 62 for notification of information related to the unmanned operation state 320.

Thus, by not giving notification of information which is unnecessary for nearby workers, it is possible to enhance the visual recognizability regarding whether or not what is informed is approach permission which is really necessary information, and it is also possible for a worker who is managing/monitoring unmanned operation to determine that the control state is not the unmanned operation state 320 (a state where external commands are not accepted) by checking that the state signaling lights 62 for notification of the state of unmanned operation are turned off.

As depicted in FIG. 8, similar to the "lighting control pattern 1," in the "lighting control pattern 2" in the manned operation state 310, the work signaling light 62*a* is turned on when the engine 16 is in operation, and the other state signaling lights are always turned off. That is, this is a lighting pattern which is the same as a hydraulic excavator that can be in only the manned operation state.

Although the safety for nearby workers can be enhanced further if it is possible to give a notification representing approach permission as in the "lighting control pattern 1," since the approach permission signaling light 62*e* is installed at a location that can be seen in the visual field of a riding operator in the operation room 4, it is conceivable that the riding operator in the operation room 4 feels annoyed if the approach permission signaling light 62*e* is kept turned on while the engine is stopped or the lock valve is at the interrupting position during suspension of work or the like.

In such a case, a notification of approach permission to nearby workers is given in such a manner that is the same as conventional manners (by using gestures, voice or sound), and it is made possible to select a pattern in which the approach permission signaling light 62*e* can be always turned off (i.e. the "lighting control pattern 2") prioritizing the work efficiency of the riding operator in the operation room 4.

As depicted in FIG. 9, the "lighting control pattern 3" in the manned operation state 310 is different from the "lighting control pattern 1" in that a state signaling light 62 that is turned on when the engine is stopped or when the lock valve 22 is at the interrupting position, that is, when it is ensured that the machine body does not start moving, is not the approach permission signaling light 62*e*, but the operation signaling light 62*d*.

Thus, concern with the "lighting control pattern 1," that is, annoyance caused by the state signaling light 62, which is turned on and comes into the visual field of a riding operator in the operation room 4 at a time of manned operation, can be solved. Since the communication signaling light 62*c* also is turned on necessarily when the operation signaling light 62*d* is turned on in the unmanned operation state 320, it is also possible for a worker who is managing/monitoring unmanned operation to determine that the control state is not the unmanned operation state 320 (i.e. a state where external commands are not accepted) even if the operation signaling light 62*d* is turned on, by checking that the communication signaling light 62*c* is turned off.

Next, lighting control at a time of the unmanned operation state 320 is explained. The external operation controller 60 retains a control table in which a lighting control pattern (see FIG. 10) of the state signaling light 62 in the unmanned operation state 320 is set.

As depicted in FIG. 10, in the unmanned operation state 320, the work signaling light 62*a* is turned on when the engine is in operation.

The warning signaling light 62*b* is turned on when the control state is the unmanned operation forced stop state 324. With the red signaling light, the warning signaling light 62*b* notifies a managing/monitoring worker that it is an anomalous state where unmanned operation cannot be continued.

The communication signaling light 62*c* is turned on when the control state is any of the unmanned-operation temporarily cancelled state 321, the unmanned operation waiting state 322, the unmanned operation work state 323, and the unmanned operation forced stop state 324 (i.e. when the control state is not the manned operation state), and additionally network connection between the machine body and the control room is normal. Since the communication signaling light 62*c* is turned off at a time of actual work in the manned operation state 310, if network connection is normal when a riding operator in the operation room 4 presses the operation state selector switch 64, and then the control state transitions to the unmanned-operation temporarily cancelled state 321, the communication signaling light 62*c* switches from the OFF state to the ON state. The worker checks that the communication signaling light 62*c* is turned on, and the warning signaling light 62*b* is turned off, and can recognize that the machine body is in a state where it performs unmanned operation.

The operation signaling light 62*d* is turned on when the control state is the unmanned operation work state 323. When the operation signaling light 62*d* is turned on, machine-body operation by a riding operator in the operation room 4 is disabled, and machine-body operation by remote (outside) commands is enabled.

The approach permission signaling light 62*e* is turned on when the control state is any of the unmanned-operation temporarily cancelled state 321, the unmanned operation waiting state 322, and the unmanned operation forced stop state 324 (i.e. when the control state is the unmanned operation state 320, but not the unmanned operation work state 323), and additionally the engine is stopped or the lock valve 22 is in the interrupting state (i.e. it is ensured that the machine does not start moving). Even when the engine is stopped or the lock valve 22 is at the interrupting position, the approach permission signaling light 62*e* is not turned on (is turned off) if the control state is the unmanned operation work state 323. This takes into consideration a possibility that the machine body starts moving due to a remote (outside) command switching the lock valve 22 to an unlocking state in a case of the unmanned operation work state 323 even if the lock valve 22 is in the interrupting state, and the safety is enhanced further by notifying nearby workers of approach permission only when it is ensured that remote (outside) commands are not accepted.

The action request signaling light 62*f* is turned on when an anomalous state where a worker is requested to ride in the operation room to take a particular action has emerged in the machine body in the unmanned operation state 320 (this is one of conditions of transition to the unmanned operation forced stop state 324) or when the machine body has received a signal for turning on the action request signaling light 62*f*. Here, it is assumed that the signal for turning on the action request signaling light 62*f* is transmitted via a network from the control room managing/monitoring unmanned operation.

For example, when network connection between the machine body and the control room is disconnected undesirably during remote operation work is being implemented in an unmanned operation work state 620 (i.e. in a case of the unmanned operation work state 323), the operation state transitions from the unmanned operation work state 323 to the unmanned operation forced stop state 324 in the unmanned operation state 320, and the external operation controller 60 stops actions of the hydraulic actuators 1*a*, 2*a*, 3*d*, 3*e*, and 3*f*, and switches the lock valve 22 to the interrupting position. The machine body in this state (unmanned operation forced stop state 324) cannot be operated by remote (outside) commands, but if the machine body in the anomalous state is left alone for a long time, it can disrupt work. Accordingly, it is necessary to change the machine-body posture, move the machine body to a safe location or a particular evacuation site, and so on in order to perform recovery work. However, it can be imagined that when a managing/monitoring worker heads to the machine body from the control room which is at a location far away from the machine body, it takes time undesirably, and when there is only one managing/monitoring worker, there are no other workers to check information on the control-room side, thereby lowering the efficiency of recovery work undesirably.

In such a case, by sharing in advance a rule that "when the action request signaling light 62*f* is turned on, a nearby worker rides in the operation room 4 of the machine body, and cooperates in recovery work" as a operational use rule of the work site serving as a premises, it is possible to ask a worker near the machine body to cooperate by turning on the action request signaling light 62*f* when the control state becomes the unmanned operation forced stop state 324.

Furthermore, by causing the monitor (display device 5) in the operation room 4 to display contact information (telephone number) of the control room or a managing/monitoring worker, or information about operation and actions that a riding worker is asked to perform or take when the action request signaling light 62*f* is turned on, it becomes possible to perform recovery work smoothly.

As another scene, for example, even where the excavator 100 is in operation normally in the unmanned operation work state, the action request signaling light ON signal can also be transmitted simultaneously with transmission of the unmanned operation stop signal from the control room to the machine body if it is now desired to have the situation around the machine body visually checked directly. In this case also, by asking a nearby worker to cooperate by riding in the operation room, the stop time of the machine body can be shortened, and the work efficiency of the work site as a whole can be enhanced.

In addition, if audio guidance is further output from the external speaker 66 connected to the external operation controller 60 at this time when the action request signaling light 62*f* is turned on, it is also possible to make it easier for nearby workers to notice the machine-body state.

In addition, with operational use like the one mentioned below regarding turning off of the action request signaling light 62*f*, it is possible to further enhance the work efficiency. For example, it is assumed that in a case where, at a time when the action request signaling light 62*f* is turned on, a worker is asked to ride in the hydraulic excavator 100, and she/he is implementing work for recovery, the machine-body state at that time (e.g. information regarding an anomalous state, a machine-body posture or the like) is monitored by the external operation controller 60 or the remote control room. At this time, when the external operation controller 60 or the control room decides that OFF conditions, which include completion of the work by the worker having been asked to ride in the excavator 100 for performing the work (e.g. the anomalous state is solved, the machine-body posture is changed to a specified machine-body posture), are satisfied, the external operation controller 60 turns off the action request signaling light 62*f*.

With this configuration, the worker who is riding in the hydraulic excavator 100 after looking at the action request signaling light 62*f* that is turned on can more clearly know that an action that she/he is requested to take has been completed. Accordingly, it is possible to make a determination that the work has been completed early and accurately, and the work efficiency as a work site can be enhanced further.

Note that at this time, if the worker who is riding in the hydraulic excavator 100 and a managing/monitoring worker of the machine body communicate information with each other by making a call and so on through a worker communication terminal, the communication terminal 61 in the operation room 4, and the like, the work can be performed earlier and more accurately.

Advantages of the thus-configured present embodiment are explained.

When a work machine performs unmanned operation (remote operation, automated operation), it is conceivable that there arises a case where a worker near the construction machine is required to approach the machine body performing the unmanned operation inevitably necessary or a case where the construction machine is required to suspend the work.

At this time, for example, even where the nearby worker can forcibly stop the construction machine performing the unmanned operation (remote operation, automated operation), the work by the unmanned operation is unintendedly suspended or stopped undesirably if the unmanned operation is actually stopped, and this cause unnecessary deterioration of the work efficiency undesirably.

Even where a manager who is remotely managing the unmanned operation (remote operation, automated operation) of the construction machine is asked to temporarily suspend the unmanned operation by any notification means, a nearby worker cannot approach the work machine since she/he cannot check the safety unless the nearby worker is informed that the machine body is in a state where it does not start moving, and this causes deterioration of the work efficiency undesirably. In addition, it is also conceivable that even where the unmanned operation is not suspended, a nearby worker misinterprets the motionless appearance of the work machine as indicative of suspension of the unmanned operation, and carelessly approaches the construction machine undesirably.

In addition, where unmanned operation (remote operation/automated operation) of the work machine is stopped undesirably due to some malfunction such as interruption of network communication, it is necessary for someone in workers including a manager to ride in the operation room to operate the machine body in order to stop the engine of the construction machine that is in operation, cause the construction machine to withdraw temporarily, and so on. However, where the construction machine and the control room (i.e. the manager) are far away from each other, it undesirably takes an enormous amount of time for the manager to move to the construction machine, and the work takes an enormous amount of time undesirably.

In contrast to this, in the present embodiment, the hydraulic excavator 100 that performs work at a construction site includes: the machine controller 11 that controls an action of the hydraulic excavator 100; the external operation controller 60 that controls unmanned operation that does not require operation performed by a riding operator in the operation room 4, by generating a control signal according to an operation signal received from the outside via the communication terminal 61, and sending the control signal to the machine controller 11; the approach permission signaling light 62*e* that signals permission for a worker to approach the hydraulic excavator 100; and the action request signaling light 62*f* that signals a request for a particular action performed by a nearby worker by riding in the operation room, in which the external operation controller 60 controls the approach permission signaling light 62*e* to be turned on when it is decided that approach of the worker to the hydraulic excavator 100 can be tolerated according to information collected by the machine controller 11, and also controls the action request signaling light 62*f* to be turned on when it is decided that it is necessary to request a nearby worker to take a particular action or when a signal requesting a nearby worker to take a particular action is received via the communication terminal 61. Accordingly, it is possible to succinctly notify nearby workers and a manager of a machine-body action state, and to realize both the safety and work efficiency of the workers near the machine body and the manager.

Additional Notes

Note that the present invention is not limited to the embodiment described above, but includes various combinations of modification examples and embodiments within the scope not departing from the gist of the present invention. In addition, the present invention is not limited to those including all the constituent elements explained in the embodiment described above, but also includes those from which some of the constituent elements are changed or deleted.

For example, whereas it is explained that information allocated to each of the information signaling lights 62 is informed to workers near the hydraulic excavator 100 or a managing/monitoring worker in the control room by turning on the state signaling lights 62 in the case illustrated in the embodiment described above, this is not the sole example, and, for example, information is informed by flashing the state signaling lights 62 in other possible configuration.

In addition, some or all of the constituent elements, functionalities and the like described above may be realized by designing them, for example, in an integrated circuit, and so on. In addition, the constituent elements, functionalities, and the like described above may be realized by software by a processor interpreting and executing a program to realize respective functionalities.

DESCRIPTION OF REFERENCE CHARACTERS

1: Lower travel structure
1*a*: Travel hydraulic motor
1*b*: Crawler
2: Upper swing structure
2*a*: Swing hydraulic motor
3: Front work implement
3*a*: Boom
3*b*: Arm
3*c*: Bucket
3*d*: Boom cylinder
3*e*: Arm cylinder
3*f*: Bucket cylinder
4: Operation room
5: Display device
6 to 8: Angle sensor
9: Inclination sensor
10: Swing angle sensor
11: Machine controller
12: Lock switch
13: Switch box
14: Monitor controller
15: Operation device
16: Engine
17: Engine controller
18: Hydraulic pump
19: Control valve
20: Pilot pump
21: Pump regulator
22: Lock valve
23: Pump flow rate control pressure sensor
24: Pilot pressure control reducing valve
25: Operation pressure sensor
26: Pump delivery pressure sensor
60: External operation controller
61: Communication terminal
62: State signaling light
62*a*: Work signaling light
62*b*: Warning signaling light
62*c*: Communication signaling light
62*d*: Operation signaling light
62*e*: Approach permission signaling light
62*f*: Action request signaling light
63: Camera
64: Operation state selector switch
65: Lighting condition selector switch
66: External speaker
100: Hydraulic excavator
State signaling light's name: 221*a* to 221*f*
222: Display color
223: Lighting condition
300: State
310: Manned operation state
320: Unmanned operation state
321: Unmanned-operation temporarily cancelled state
322: Unmanned operation waiting state
323: Unmanned operation work state
324: Unmanned operation forced stop state
620: Unmanned operation work state

The invention claimed is:

1. A construction machine whose operation can be switched between manned operation and unmanned operation, the construction machine comprising:

a machine controller that controls an action of the construction machine;

an external operation controller that controls unmanned operation that does not require operation by an operator riding in an operation room, by generating a control signal according to an operation signal received from an outside via a communication terminal, and sending the control signal to the machine controller;

an approach permission signaling light that signals permission for a worker to approach the construction machine; and an action request signaling light that signals a request for riding in the operation room and performing a particular action for recovery work from an anomalous state to a nearby worker, wherein the approach permission signaling light is arranged on a front left side of the operation room such that the approach permission signaling light can be easily recognized by a riding operator in the operation room, and the external operation controller is configured to control the approach permission signaling light to be turned on and the action request signaling light to be turned off at a time of manned operation when an engine has been stopped or the construction machine action is disabled because a lock valve that switches an action of the construction machine between permission and prohibition is at an interrupting position, and when it is decided that approach of the worker to the construction machine can be tolerated according to information collected by the machine controller, and control the approach permission signaling light and the action request signaling light to be turned on after stopping the unmanned operation and switching the lock valve to the interrupting position and so that operation only by the riding operator in the operation room is enabled at a time of unmanned operation when the anomalous state occurs that requests the worker to ride in the operation room and perform the particular action, or when a signal for turning on the action request signaling light is received by the construction machine from a control room that is managing/monitoring the unmanned operation.

* * * * *